United States Patent [19]

Ordas

[11] 4,407,218

[45] Oct. 4, 1983

[54] APPARATUS AND METHOD FOR APPLYING HOT WAX TO SKIS

[76] Inventor: Dale Ordas, 1520 38th St., Sacramento, Calif. 95825

[21] Appl. No.: 409,650

[22] Filed: Aug. 19, 1982

Related U.S. Application Data

[63] Continuation-in-part of Ser. No. 243,367, Mar. 13, 1981, abandoned.

[51] Int. Cl.[3] ..... B05C 1/08

[52] U.S. Cl. ..... 118/59; 118/72; 118/101; 118/202; 118/244; 118/258

[58] Field of Search ..... 118/244, 258, 101, 202, 118/72, 13, 59; 427/428

[56] References Cited

U.S. PATENT DOCUMENTS

| | | | |
|---|---|---|---|
| 2,249,088 | 7/1941 | Murray | 118/101 |
| 3,000,347 | 9/1961 | Schaefer | 118/203 X |
| 3,116,166 | 12/1963 | Halley | 118/202 |
| 3,431,890 | 3/1969 | Ulary | 118/637 |
| 4,182,786 | 1/1980 | Hertel | 427/428 |

FOREIGN PATENT DOCUMENTS

| | | | |
|---|---|---|---|
| 128411 | 5/1932 | Austria | 118/72 |
| 932086 | 3/1948 | France | 118/244 |
| 548510 | 9/1956 | Italy | 118/72 |
| 425577 | 11/1966 | Switzerland | 118/72 |
| 602146 | 7/1978 | Switzerland | 118/202 |

*Primary Examiner*—Shrive P. Beck
*Attorney, Agent, or Firm*—Mark C. Jacobs

[57] ABSTRACT

Apparatus and method for applying hot wax to skis is disclosed wherein a ski is moved across a heated roller in tangential contact therewith, the roller being rotatable through a bath of melted wax disposed in a tray beneath the roller, thereby applying hot wax to the ski. Thereafter, the ski may be drawn across a heated platen ironing the hot wax on the ski. Optionally, the platen may be used to preheat the ski. The platen is pivotable to help the user achieve a satisfactory angle for wax application.

10 Claims, 8 Drawing Figures

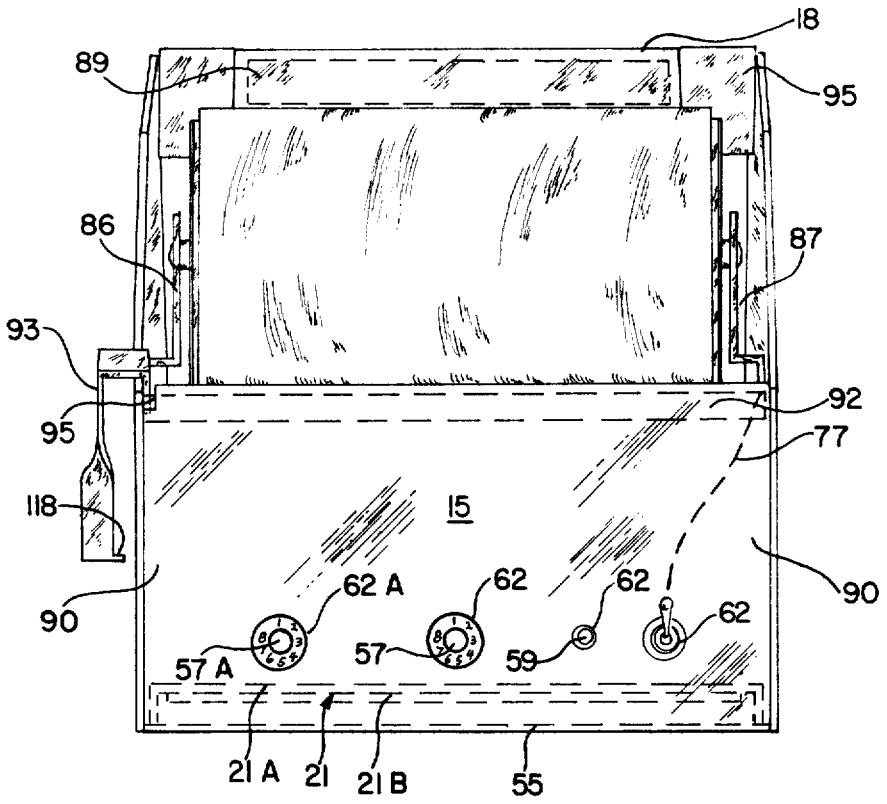
FIG. 5
FIG. 6
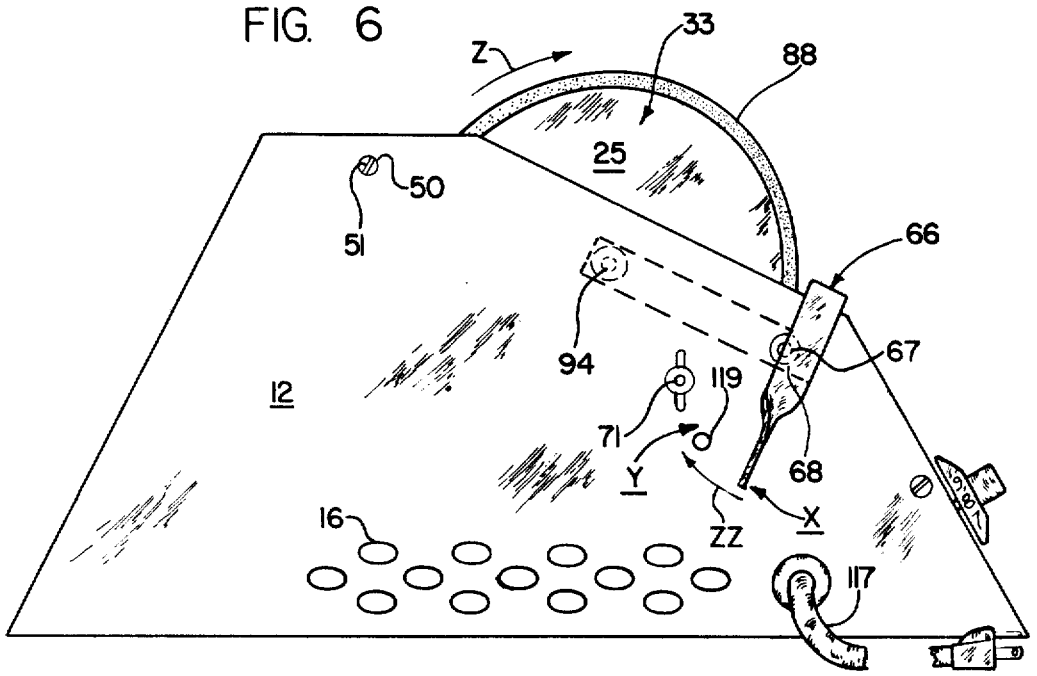

APPARATUS AND METHOD FOR APPLYING HOT WAX TO SKIS

PRIOR APPLICATION

This application is a continuation in part of Ser. No. 243,367, filed Mar. 13, 1981 now abandoned.

BACKGROUND OF THE INVENTION

1. Field of the Invention

The invention relates to ski hot wax applicators; and, more particularly, to apparatus and method for applying hot wax uniformly to the bottom of a ski and ironing the same after such application.

2. Description of the Prior Art

It has been known for years that hot wax is far superior to cold wax for improving ski performance. There have been many suggestions over the years as to how to heat the wax to a proper temperature, without altering its properties, and apply such wax uniformly and evenly. For example, U.S. Pat. Nos. 4,029,046 and 4,182,786 to Hertel describe an applicator which uses a heating sheet on a tub exterior to melt the ski wax and which has a roller passing through the wax in the tub. The roller itself is not heated and efficient operation requires uniform contact between the ski and roller surface. There is also no means for smoothing the wax after application and the tub is not removable for cleaning. Further, the relatively inefficient heating means of Hertel requires quite a bit of time to heat the wax to its melting point. This renders the Hertel applicator inconvenient for commercial use, particularly where the wax must be changed.

Other devices have been suggested in the past but are relatively expensive, also require long heating times, are excessively hot to the touch and do not provide means for ironing out the wax on the ski after application. There is thus a need for an applicator having a roller that is heated, a removable tray for cleaning and replacing wax, and means for ironing the wax after application.

SUMMARY OF THE INVENTION

It is the object of the invention to provide an improved apparatus and method for applying hot wax to a ski.

It is a further object of this invention to apply hot wax to a ski and smooth out the wax after application.

It is still another object of this invention to provide such apparatus wherein the roller holds the tray containing the wax in position and the tray is removable.

It is still another object of this invention to carry out the foregoing objects in a simple inexpensive manner which short heating times required to heat the wax.

These and other objects are preferably accomplished by providing a heated roller for tangential contact with a ski, the roller being rotatable through a bath of melted wax disposed in a tray beneath the roller, thereby applying hot wax to the ski. Thereafter, the ski may be drawn across a heated pivotable platen to iron the hot wax on the ski. Optionally, the platen may be used to preheat the ski, prior to wax application.

BRIEF DESCRIPTION OF THE DRAWINGS

FIG. 5 is a front elevational view of the device of FIG. 1;

FIG. 6 is a left elevational view thereof;

DESCRIPTION OF THE PREFERRED EMBODIMENT

Figure 1:
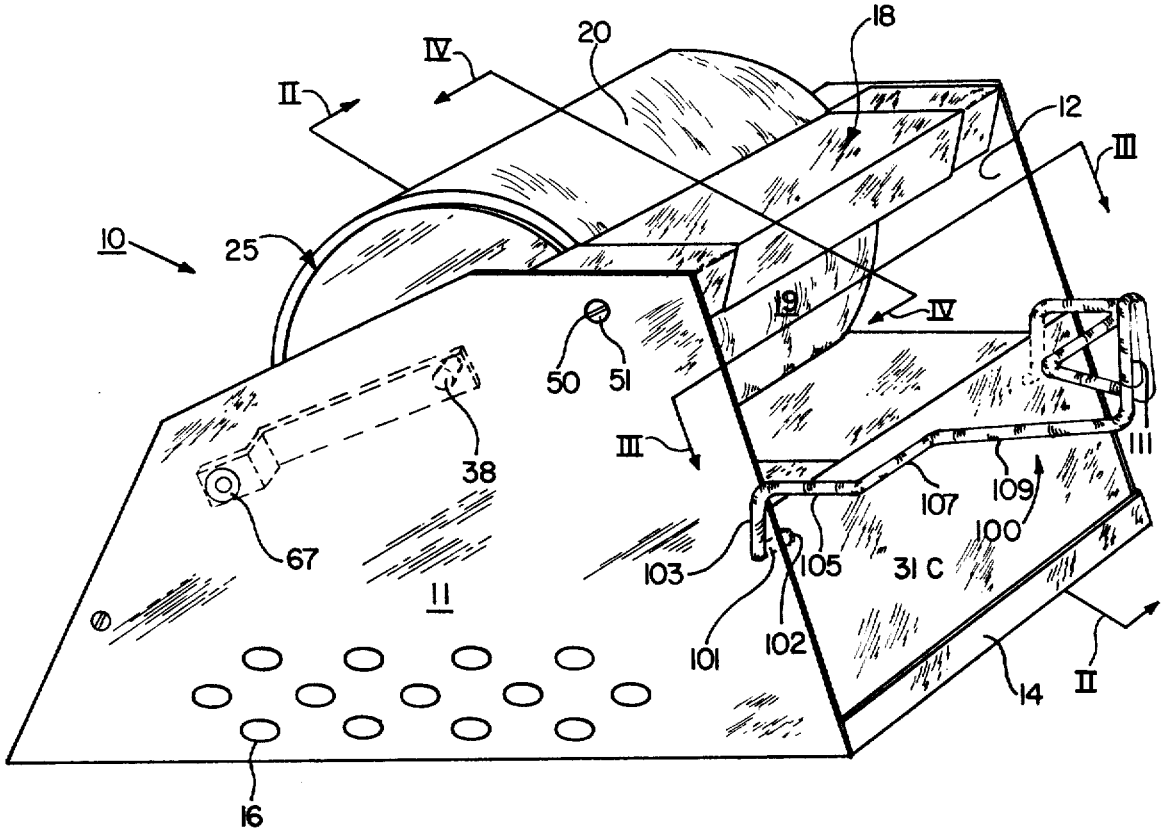
FIG. 1 is a perspective view of apparatus for applying hot wax to skis in accord with the teachings of the invention.

Referring now to FIG. 1 of the drawing, a hot wax applicator 10 is shown having a pair of spaced side walls 11, 12, a bottom wall 13 and a sloped rear wall 14. A front wall 15, similar to wall 14, extends from bottom wall 13 sloping rearwardly toward wall 14. Wall 14 slopes upward toward wall 15 from 175 commencement. See FIG. 22.

A plurality of air holes 16 may be provided in one or more walls, such as side wall 11, for ventilation. Suitable screws 17 or the like may be provided for securing the various walls together, e.g., as by providing aligned flanges on each wall section which are then secured together. Of course, any suitable securing means may be used depending on the materials used. Screws 17 on one wall, e.g., wall 11 may be removable for access to the interior for cleaning purposes, through removal of reservoir tray 31 may provide easier access.

There is no top wall per se but a heated, pivotable platen 18, whose function will be discussed, interconnects side walls 11, 12 forming open spaces 19, 20 on each side of platen 18 respectively.

Figure 2:
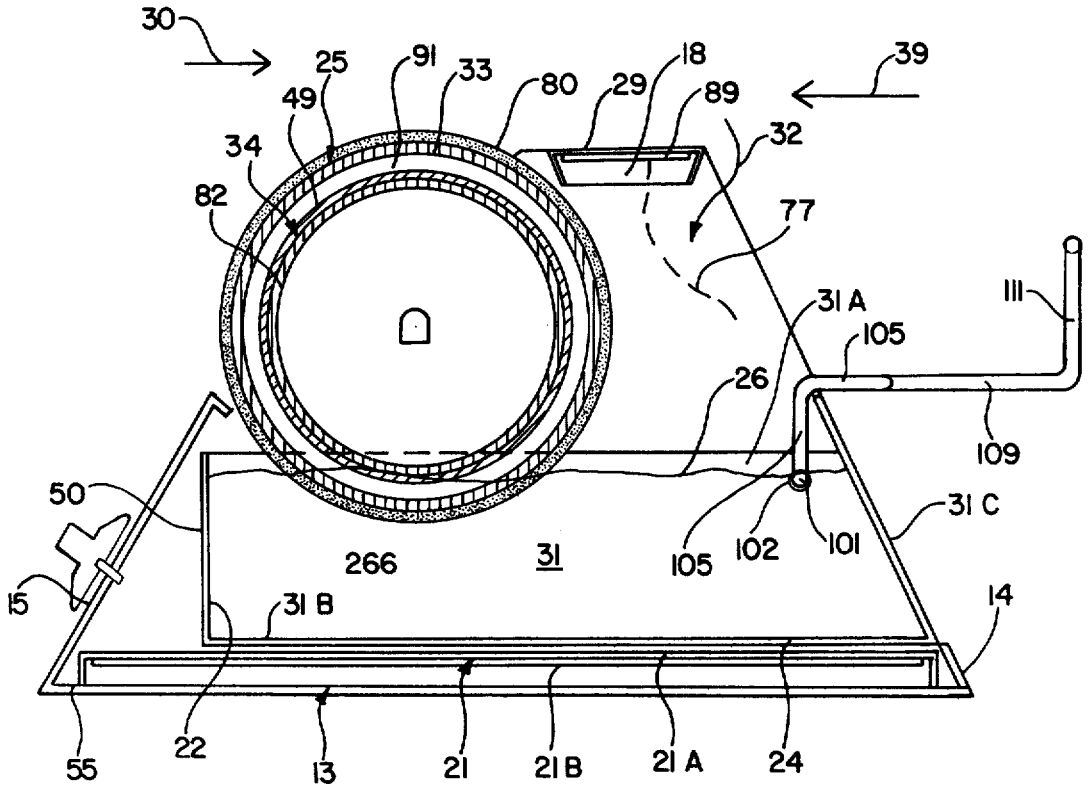
FIG. 2 is a sectional view taken along lines II—II of FIG. 1.

As shown in FIG. 2, a tray 31 having spaced parallel sides 31A, a bottom 31B, an inwardly sloping front panel 31C and a generally vertical rear panel 31D is mounted internally of the applicator of this invention 10. Front panel 31C may be of higher elevation than rear panel to help prevent sloshing of melted wax. A cavity 22 is provided in interior of applicator 10 into which is disposed the tray 31. Tray 31 rests upon pan heater 21. Pan heater 21 consists of inverted U pan 21A having a heat strip 21, available from various market sources, adhesed thereunder.

It is seen that the heat transfers from strip 21B to pan 21A to the underside of tray 21A to the underside of tray 31 in order to melt the wax 266. Insulation 55 is interposed beneath the arms of the U pan 21A and bottom wall 13 to prevent metal to metal contact.

Wall 14 may terminate as shown flush with the top edge of pan heater 21, or wall 14 may extend upward slightly above the height of heater 21 just enough that when tray 31 is at rest on heater 21, the tray 31 is prevented from sliding out of its operating position. This last presupposes that the length of side walls 31A are slightly reduced from that of FIG. 2, such that front panel 31C will be disposed inward of wall 14 to permit the disposition of the tray behind the heightened wall 14.

Tray 31 may be made of any suitable material, such as aluminum, or heat resistant plastic. Tray 31 rests in cavity 22 upon the inverted U pan during operation. Melted wax 266 is depicted therein for use in ski waxing as seen in FIG. 2.

Tray 31 also includes a handle 100 composed of several parts. Handle 100, may be formed from aluminum or steel round stock, and includes a pair of inwardly directed spaced aligned first portions 101, inserted into aligned bores 102, second portions 103, normally disposed upward from the exterior end of said first portions, and terminating in third portions 105 which are normal to said second portions, and which are directed outwardly at right angles to said first portions 101, to a point of commencement of a fourth portions 107, each of which fourth portions is aligned horizontally and extends parallel to its first portion, and each of which is inwadly directed toward the other of same, to a point of commencement of a pair of outwardly converging fifth portions 109, horizontally aligned with said fourth portions and with said third portions, said fifth portions intersecting the termini of a generally vertically disposed inverted V sixth portion. The handle 100 is intended to be grasped by its fifth and sixth portions.

Further to the discussion of insulation, not shown in FIG. 1 but seen only in FIG. 5 for ease of understanding of the drawings, an insulation sheet 90 may be adhesed to walls 11 and 12 to reduce heat the side walls of device 10.

Referring again to FIG. 1 and also to FIG. 2, a roller 25 is journaled for rotation in applicator 10 and passes through a substantial portion of the interior of tray 31 (the level of melted wax in tray 31 being indicated by line 26 in FIG. 2). Roller 25 comprises metallic drum 33 on which is mounted a rubber cylinder 80 for wax takeup from within tray 31. See infra and supra.

As particularly contemplated in the invention, both the platen and roller 25 may be heated. Each can be separately thermostatically controlled as seen from FIG. 5 wherein thermostats 57 and 57A are shown mounted in their respective mounting holes 62 and 62A. A lower cost version would have only the pan heater thermostatically controlled.

Platen 18 is pivoted on each end as seen in FIG. 2 by bolt 51 in bore 50 to provide a platen upper surface 29 that can be angled to the convenience of the user such that the ski can be slid easily from the roller 25 across surface 29.

Optionally platen 18 may be used to preheat the ski prior to wax application. While the direction of travel is normally that of arrow 30 in FIG. 2, ie from roller to platen, if the ski is preheated, the path of travel could be against the arrow, across the platen 18 to the roller 25. Since the roller is not motorized, it can travel either clockwise or counterclockwise according to the desires of the user.

Indeed, the user could preheat the ski, by running the ski over the heated surface 29 of the platen in the direction of arrow 39, and then turn the ski around to carry out the normal procedure of wax application followed by ironing of the wax, in the direction of arrow 30.

As can be readily understood the ski is tangentially moved across roller 25 in contact therewith in the direction of the arrow 30 per FIG. 2 to coat the ski's undersurface with hot wax from the hot wax reservoir 40 of tray 31, and across the heated surface 29 of platen 18. The latter smooths out or irons the hot wax on the ski, while the excess drips off of the platen 18 back into the reservoir 40 as indicated by arrow 32. It is for this reason that the device 10 was designed to have the tray 31 extend laterally past the width of the platen as is readily seen in FIG. 2.

Figure 3:
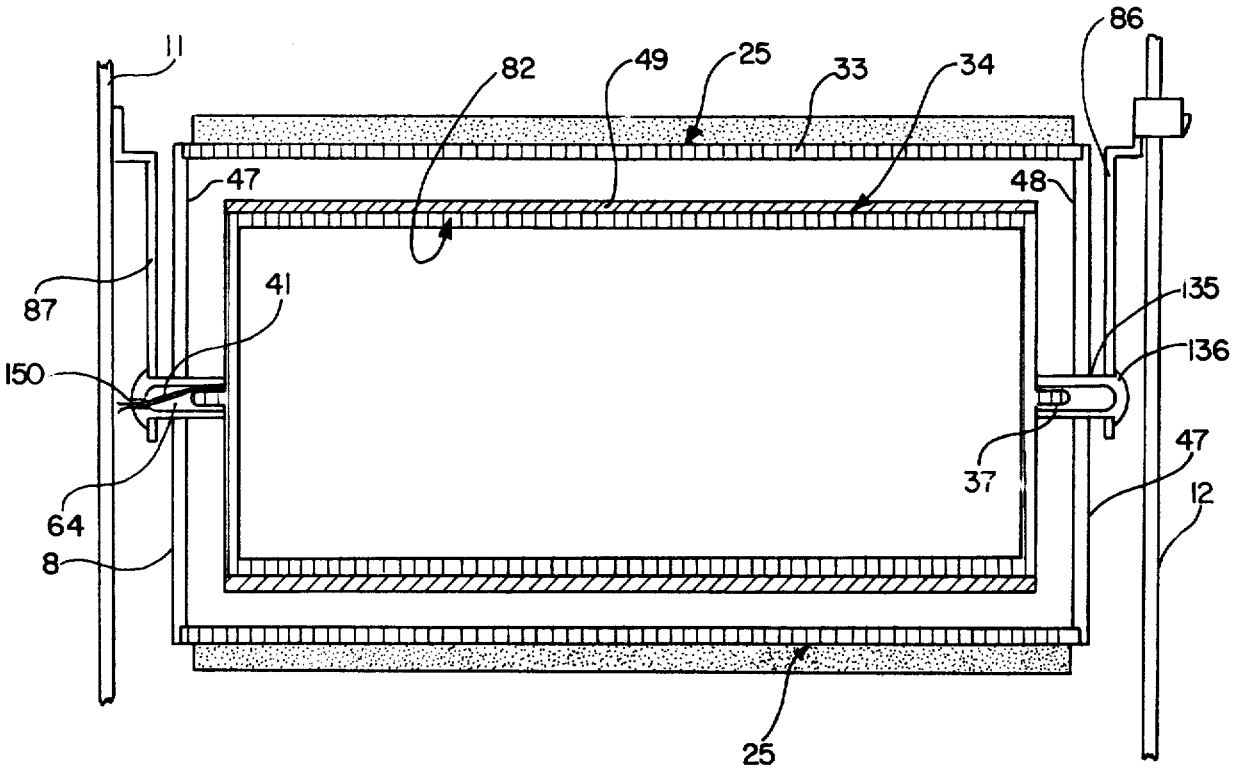
FIG. 3 is a view taken along lines III—III of FIG. 1.
Figure 4:
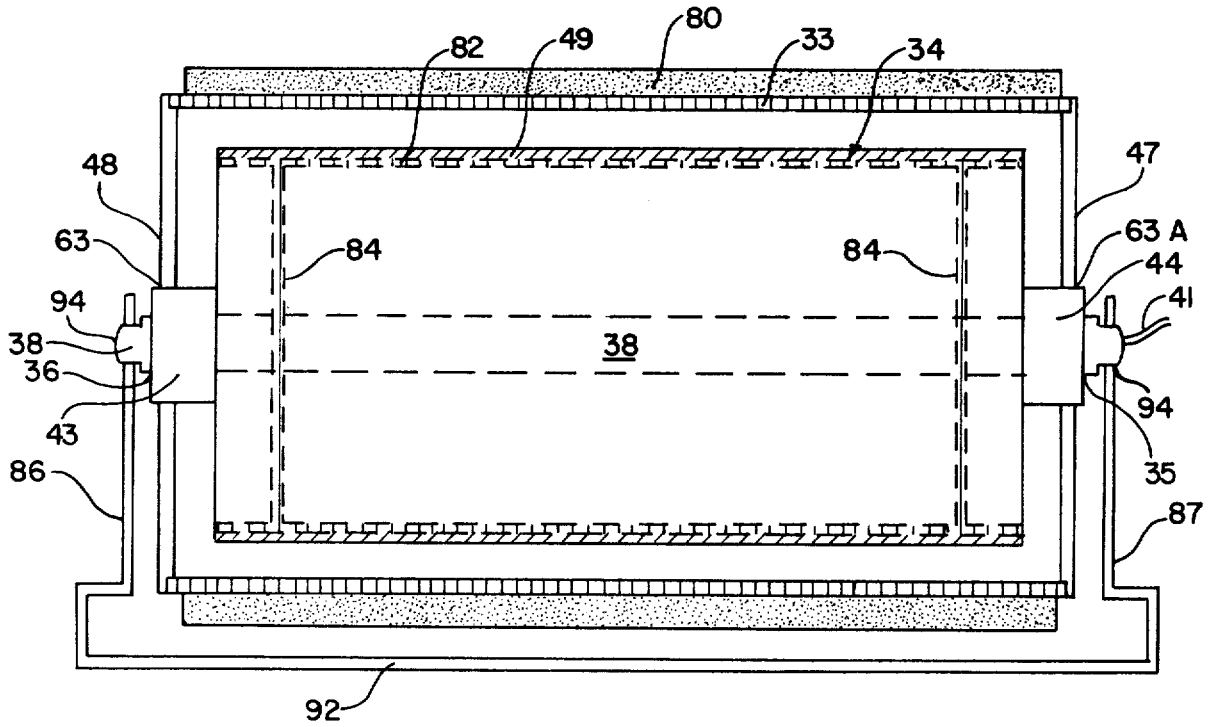
FIG. 4 is a view taken along lines IV—IV of FIG. 1.
Figure 7:
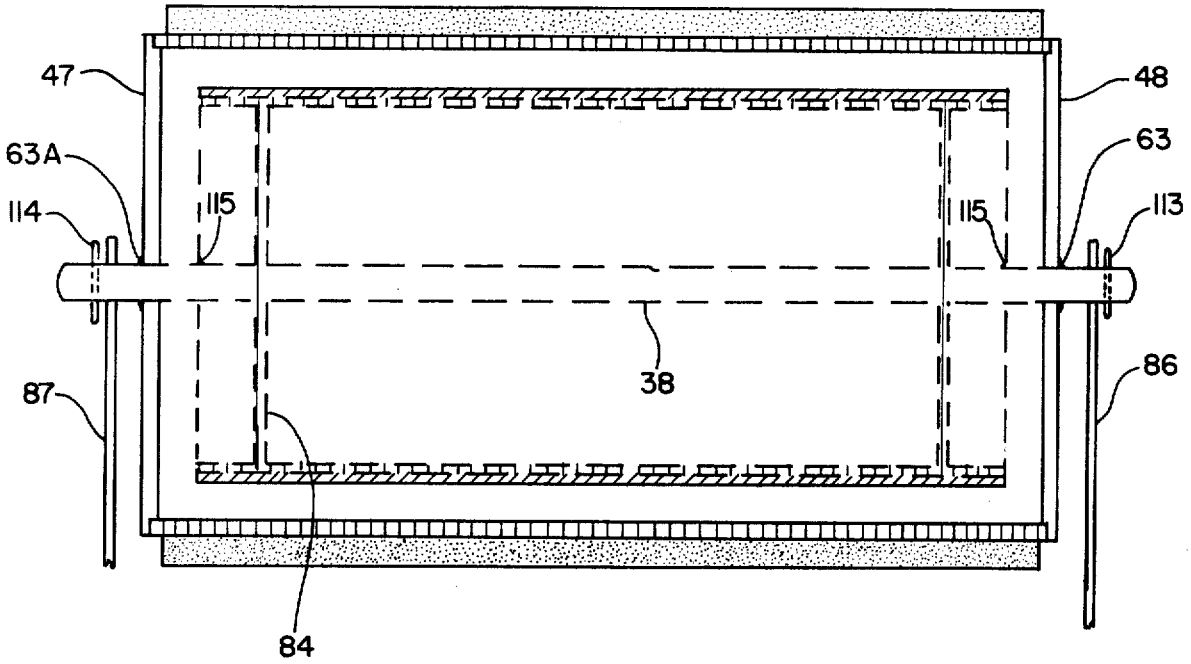
FIG. 7 is a view similar to FIG. 3 illustrating a variant in the invention.
Figure 8:
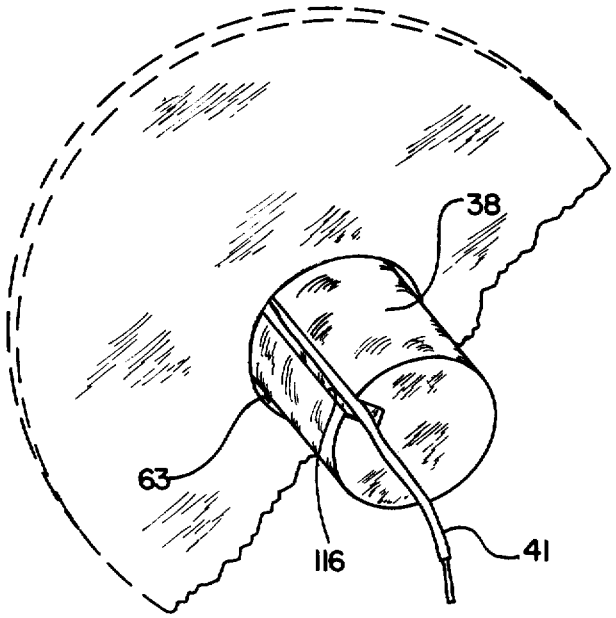
FIG. 8 is a closeup perspective view of a portion of this invention.

Roller 25 is shown in FIGS. 2, 3 and 4 as being comprised of a hollow drum 33 spaced from a heating element 34 which heating element may be a steel tube 82 or the like, which is covered with a heating material 49. The outer drum 33 includes a pair of end walls 47 and 48 having a central aperture therein 63, 63A, which are journaled for rotation around shaft 38, which in turn is secured to arms 86 and 87 by being inserted through bores 94, 94' by a respective keeper 113, 114. Reference is made to FIG. 7.

Alternatively as shown in FIG. 4, a bearing 43, 44 may be inserted into said apertures 63, 63A as by press fit, which bearing would have an opening 35, 36 journaled for rotation around shaft 38. The shaft in turn would be secured by the keepers as above.

Heating element 34 comprises an inner drum 82 which is overlaid with a heat strip 49 per FIGS. 2 and 3. Heating element 34 is disposed within the roller 25, and said element 34 has its heat strip 49 spaced slightly from the interior surface of roller 25. This can be achieved in one of several ways. Firstly, the end plates 84 of heating element 34 can be welded, brazed, adhesed or otherwise secured at the desired location along shaft 38. Reference is made to weld points 115 of FIG. 7.

If a bearing is used as in FIG. 4, then the end plates 84 should be recessed inwardly within the drum 82 to ensure clearance between the bearing and the end plate 84. To properly dispose the heating element 34 within the roller, again, the end plates may be secured to the shaft in the manner aforesaid.

An alternate means of mounting the roller and the heating element is shown in FIG. 3. Here pin 136 having a recess 135 therein, is inserted into bore 94 of the arms 86 and 87. End wall 47 and 48 rotate around pin 136, while heater element 34, which has a nipple 37 located on each end plate 84 is journaled for rotation within recess 135 of pin 136. Suitable spacers, not shown, prevent the roller from impinging upon arms 86 and 87, while the edge of pin 136 prevents the heater element 34 from moving laterally. In the construction just above, the need for shaft 38 is obviated.

In order to power the heater 34, wires 41 may exit through an aperture 150 as shown in FIG. 3; or a slot 116 can be cut in the shaft 38 for the wires 41 egress. Other ways of delivering wires 41 for connection to a power source are readily recognizable. Wires 41 after being electrically connected to a thermostat switch 57 in conventional manner are connected to incoming power line 117 per FIG. 6 which passes through a suitable opening in wall 12.

Roller 25 is mounted in bores 94 of arms 86, 87 which arms are interconnected by cross arm which is shown in FIG. 4, whereas the arms 86, 87 are shown discontinuous in other figures. Arms 86, 87 are pivotally mounted by pins 68 in bore 67 in the side walls 11 and 12 of device 10.

The arm raiser 66 having an inward extending boss 118 rides in slot 95, per FIG. 5 in its traverse from its rest position at X to a position at location Y at which location boss 118 can be inserted into aperture 119 to retain the roller 25 in a raised position. Roller 25 moves according to arrow Z as arm raiser 66 moves according to arrow ZZ.

It can be seen that roller 25 can be removed from applicator 10 merely by raising the arms attached thereto. Thus the roller 25 may be changed or replaced or lifted out of the way of tray 31 so the wax bath may be removed for cleaning or replenishing. The roller 25 also acts to keep tray 31 in place. See FIG. 2.

The downward travel of the pivoting arms is limited by limiter 71 which can be tightened within slot 69. See FIG. 6. Limiter 71 is merely an inwardly directed plate placed in the path of one arm.

Air holes 16 also assist in keeping the external temperature of applicator 10 down so that the operator cannot get burned.

For the three heaters employed, platen, pan and roller, any suitable heater may be used, such as silicone rubber heater available in the marketplace, and comprising flexible roller sheets with resistance wire elements therein, and preferably some or all are thermostatically controlled. Such heaters warm up almost instantaneously thus rendering applicator 10 useful in a very short time.

Here all three, namely the platen heater 89, discussed in detail infra, the inner drum heater 49, and pan heater strip 21B are all silicone heaters, all of which are electrically connected to thermostats 57 and 51A secured conventionally in bore 62 of wall 15. Preferably heater and heater are connected to thermostats 57, while heater is connected to thermostat 57A. Optionally all three can be tied to one thermostat. In FIG. 5, a power indicator light 59 and a power on-off toggle switch 61 are shown mounted in similar fashion. p The indicator light 59 and switch 61 are conventionally wired to the heaters which are energized by a source of electricity, through a 110° V AC cord 117 shown in FIG. 6.

The actual use of platen 18 is optional but is recommended as heating element 89 is therein provided. That is, side walls 11, 12 may have wires leading to a heating element 89 (FIG. 2) in the interior of platen 18. Although it is preferable to apply the wax and smooth it, ie, iron it, on the skin via platen 18, as discussed above, either alternately or in addition, the ski surface to be waxed may be preheated by passing the same over and in contact with heated platen 18 first.

Also roller 25 may be made vertically adjustable by suitable stops of the like to carry out this feature in any way desired as has been discussed with respect to limiter 71. Optionally platen 18 may also be vertically adjusted by replacing bore 50 in side walls 11, 12 with a vertical slot. Since the operator's use of platen 18 is optional, it is within the scope of the invention to have heater 89 wired separately to its own switch and optional indicator light.

While the outer surface of roller 25 may be covered with rubber 80 if desired, per disclosure herein, direct metallic tray transfer by drum contact with the wax 266 is also contemplated. Preferably rubber 80 is used.

Though not shown, the tray 31 can be insulated to help retain the heat therein to ensure that wax 266 stays melted longer. Insulation pads, can be placed along the front, back and side walls thereof, in a manner known to the art.

To recapitulate the use, it is seen that as the roller 25 rotates or revolves through wax 266, the hot wax (heated by pan heater 21) is kept hot by the presence of heat in roller 25, transferred to the outer surface of roller 25 and deposited on the surface of a ski coming into contact therewith. The ski may either be preheated, by drawing it across platen 18 first, or the platen may be used to smooth or iron the hot wax on the ski after coating the same.

In this manner, an efficient system is provided for applying wax to the skis. The applicator or the invention heats up quickly and is relatively inexpensive and not dangerously hot to the touch. The roller may be easily lifted out entirely or aside for tray removal.

The handle 100 previously described has the unique advantage of permitting the operator to readily slide the tray 31 out of device 10 after lifting the roller 25 out of the way without burning the operator's hand. This is true because the handle being long dissipates any heat it absorbed, and because being located at the top relative to the tray, the tray can be drawn straight out without tipping, thereby avoiding the sloshing of molten wax. Such would not be the case with a standard drawer handle which would be centrally mounted on the wall 31C, since no downward pressure could be applied on the top edge of wall 31C as does portion 105 of the instant handle. Handle 100 being pivotable folds inwardly toward the platen 18 for easy storage.

When employed, depending on the operator's utilization angle, pressure is applied by portion 103 or 105 to wall 31C. This ensures a steady movement laterally outward. By being secured within the sidewalls rather than the front wall, it is easier to raise the tray to clear wall 14 if this elevated upon front wall 31C as discussed above. Thus it is seen that the instant sidewall pivotally mounted, superposed outwardly extending pressure applying handle is quite unique.

Though not shown a fuse may be employed to prevent circuit overload. Such fuses are conventional and would be disposed in a fuse holder mounted in one wall of the device and electrically connected to the power line 117.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. Apparatus for applying hot wax to skis comprising:

a housing;

a roller tiltably mounted to move from a lower functional position to an upper non-functional position journalled for rotation in said housing;

a fluid tight top opening chamber removably disposed in said housing below said roller for retaining hot ski wax therein;

a portion of said roller extending into the opening of said chamber, said chamber being removable upon the tilting upward of said roller;

said roller comprising a first outer drum freely rotatable about an inner drum having heating means adapted to heat the inner surface of said outer drum, whereby passing a ski over the outer surface of said outer drum and into tangential contact therewith after said outer drum has rotated through hot wax in said chamber, uniformly deposits hot wax on said ski also including a platen mounted in said housing parallel to and spaced from said roller above said chamber, whereby said ski is adapted to be passed into contact therewith either before or after contact with said roller in an unobstructed manner;

and means to tilt said roller.

2. In the apparatus of claim 1 including a second heating means for heating the wax in said chamber.

3. In the apparatus of claim 2 wherein the second wax heating means comprises a heat conductive, inverted U pan mounted to said housing and having a silicone rubber heat strip secured on its underside.

4. In the apparatus of claim 1 wherein the outer surface of said outer drum is covered with rubber.

5. In the apparatus of claim 1 wherein said drum heating means is a silicone covered wire coupled to a source of electricity adhered to the outer surface of said inner drum.

6. The apparatus of claim 1 wherein the platen is pivotally mounted.

7. In the apparatus of claim 1 wherein the platen contains a heating means to preheat the ski prior to wax application.

8. In the apparatus of claim 7 wherein said platen and said roller's heater are thermostatically controlled.

9. In the apparatus of claim 1 wherein said chamber includes an externally disposed handle.

10. In the apparatus of claim 9 wherein the handle is a sidewall pivotally mounted superposed outwardly extending pressure applying handle.

* * * * *